US009879554B2

(12) United States Patent
Kim et al.

(10) Patent No.: US 9,879,554 B2
(45) Date of Patent: Jan. 30, 2018

(54) CRIMPED INSERT FOR IMPROVED TURBINE VANE INTERNAL COOLING

(71) Applicant: SOLAR TURBINES INCORPORATED, San Diego, CA (US)

(72) Inventors: Yong Weon Kim, San Diego, CA (US); Tsuhon Lin, San Diego, CA (US); Jeffrey Stephen Carullo, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 631 days.

(21) Appl. No.: 14/593,998

(22) Filed: Jan. 9, 2015

(65) Prior Publication Data

US 2016/0201489 A1 Jul. 14, 2016

(51) Int. Cl.
*F01D 9/04* (2006.01)
*F01D 5/18* (2006.01)
*F01D 9/02* (2006.01)

(52) U.S. Cl.
CPC ..... *F01D 9/047* (2013.01); *F01D 5/189* (2013.01); *F01D 9/02* (2013.01)

(58) Field of Classification Search
CPC ..... F01D 5/189
See application file for complete search history.

(56) References Cited

U.S. PATENT DOCUMENTS 3,767,322 A * 10/1973 Durgin ..... F01D 9/042 415/115
4,086,757 A 5/1978 Karstensen et al.
4,403,917 A * 9/1983 Laffitte ..... F01D 5/188 415/115
5,516,260 A * 5/1996 Damlis ..... F01D 5/189 415/115
6,543,993 B2 * 4/2003 Burdgick ..... F01D 5/188 415/114
8,152,468 B2 4/2012 Propheter-Hinckley et al.
8,197,210 B1 6/2012 Liang
8,608,430 B1 12/2013 Liang
2003/0113201 A1 * 6/2003 Powis ..... F01D 5/189 415/1
2005/0220626 A1 10/2005 Gray
2006/0034679 A1 * 2/2006 Harding ..... F01D 5/189 415/115
2008/0260537 A1 10/2008 Lang
2010/0129195 A1 * 5/2010 Surace ..... B22C 7/02 415/115
2010/0239412 A1 9/2010 Draper
2011/0250058 A1 * 10/2011 Suchezky ..... F01D 5/147 415/189

FOREIGN PATENT DOCUMENTS

WO 2012084454 6/2012

* cited by examiner

*Primary Examiner* — Woody Lee, Jr.
(74) *Attorney, Agent, or Firm* — Procopio, Cory, Hargreaves & Savitch LLP

(57) ABSTRACT

An insert tube of a turbine vane is disclosed. The insert tube includes a pressure side wall, a suction side wall opposite and spaced apart from the pressure side wall, a leading edge, and a trailing edge opposite the leading edge. The insert tube includes a plurality of cooling channels spaced along the pressure side wall. The insert tube includes an indented portion located between the trailing edge and the pressure side wall.

20 Claims, 3 Drawing Sheets

CRIMPED INSERT FOR IMPROVED TURBINE VANE INTERNAL COOLING

TECHNICAL FIELD

The present disclosure generally pertains to gas turbine engines, and is more particularly directed toward an insert for a turbine vane.

BACKGROUND

Gas turbine engines include compressor, combustor, and turbine sections. Portions of a gas turbine engine are subject to high temperatures. In particular, high temperatures within a turbine vane of a turbine engine can cause significant damage to certain regions of the vane. An insert tube may be assembled into the turbine vane to provide airflow pathways to cool the vane.

U.S. Pat. No. 3,767,322 to G. Durgin, et al., discloses a structure for internally cooling an airfoil vane in an axial flow gas turbine. The vane defines a cavity which approximates the shape of the outer airfoil. A frame of similar shape is inserted into the cavity in spaced relation therefrom. Pressurized cooling air enters the frame, is forced through the apertures, impinges against the inner walls of the vane, and flows along the passageway to cool the vane.

The present disclosure is directed toward overcoming one or more of the problems discovered by the inventors.

SUMMARY OF THE DISCLOSURE

A metal insert tube of a turbine vane is disclosed. The insert tube includes a pressure side wall, and a suction side wall opposite and spaced apart from the pressure side wall. The insert tube may include a leading edge formed between the pressure side wall and the suction side wall at one end of the insert tube. The insert tube may include a trailing edge formed between the pressure side wall and the suction side wall at an opposite end of the insert tube from the leading edge In addition, the insert tube may include a plurality of pressure side impingement apertures spaced along the pressure side wall, and a plurality of leading edge impingement apertures spaced along the leading edge. The insert tube may also include an indented portion. The indented portion may be located between the trailing edge and the pressure side wall. The indented portion may include a curved wall adjoining the pressure side wall and extending towards the suction side wall. The indented portion may also include a flat wall adjoining the curved wall and the trailing edge.

DETAILED DESCRIPTION

The systems and methods disclosed herein include an insert tube configured to be assembled into a turbine vane.

In embodiments, the insert tube includes a tubular structure including an airfoil cross section and an indented portion. The indented portion may be located between a trailing edge and a pressure side wall of the tubular structure. The indented portion may provide a clearance between the insert tube and a cavity of the turbine vane. The clearance may allow for increased upstream flow rate from the cavity towards the trailing edge of the turbine vane. The increased flow rate may reduce dead regions in particular portions of the turbine vane.

Figure 1:
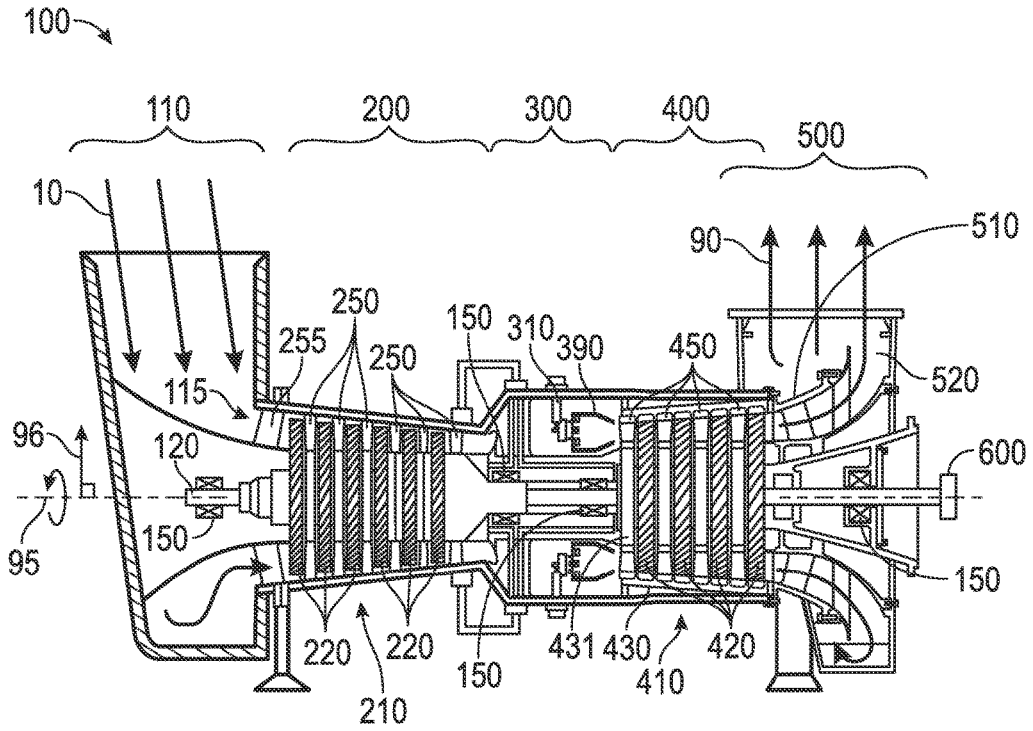
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

A gas turbine engine 100 includes an inlet 110, a shaft 120, a gas producer or compressor 200, a combustor 300, a turbine 400, an exhaust 500, and a power output coupling 600. The gas turbine engine 100 may have a single shaft or a dual shaft configuration.

The compressor 200 includes a compressor rotor assembly 210, compressor guide vanes (sometimes referred to as stators or stationary vanes) 250, and inlet guide vanes 255. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Compressor guide vanes 250 axially follow each of the compressor disk assemblies 220. Each compressor disk assembly 220 paired with the adjacent compressor guide vanes 250 that follow the compressor disk assembly 220 is considered a compressor stage. Compressor 200 includes multiple compressor stages. In some embodiments, compressor guide vanes 250 within the first few compressor stages are variable compressor guide vanes. Variable guide vanes may each be rotated about their own axis to control gas flow. Variable compressor guide vanes generally do not rotate circumferentially about center axis 95.

Inlet guide vanes 255 axially precede the compressor stages. Inlet guide vanes 255 may be rotated to modify or control the inlet flow area of the compressor 200 by an actuation system 260. In some embodiments, inlet guide vanes 255 are variable compressor guide vanes and may be rotated about their own axis.

The combustor 300 includes one or more injectors 310 and includes one or more combustion chambers 390.

The turbine 400 includes a turbine rotor assembly 410, turbine disk assemblies 420, and turbine nozzles (or nozzle ring) 450. The turbine rotor assembly 410 mechanically couples to the shaft 120. The turbine rotor assembly 410 includes one or more turbine disk assemblies 420. Each turbine disk assembly 420 includes a turbine disk that is circumferentially populated with turbine blades. Turbine nozzles 450 axially precede each of the turbine disk assemblies 420. Turbine nozzles 450 may include multiple turbine nozzle segments grouped together to form a ring. Each turbine disk assembly 420 paired with the adjacent turbine nozzles 450 that precede the turbine disk assembly 420 is considered a turbine stage. Turbine 400 includes multiple turbine stages.

The exhaust 500 includes an exhaust diffuser 510 and an exhaust collector 520. The power output coupling 600 may be located at an end of shaft 120.

Figure 2:
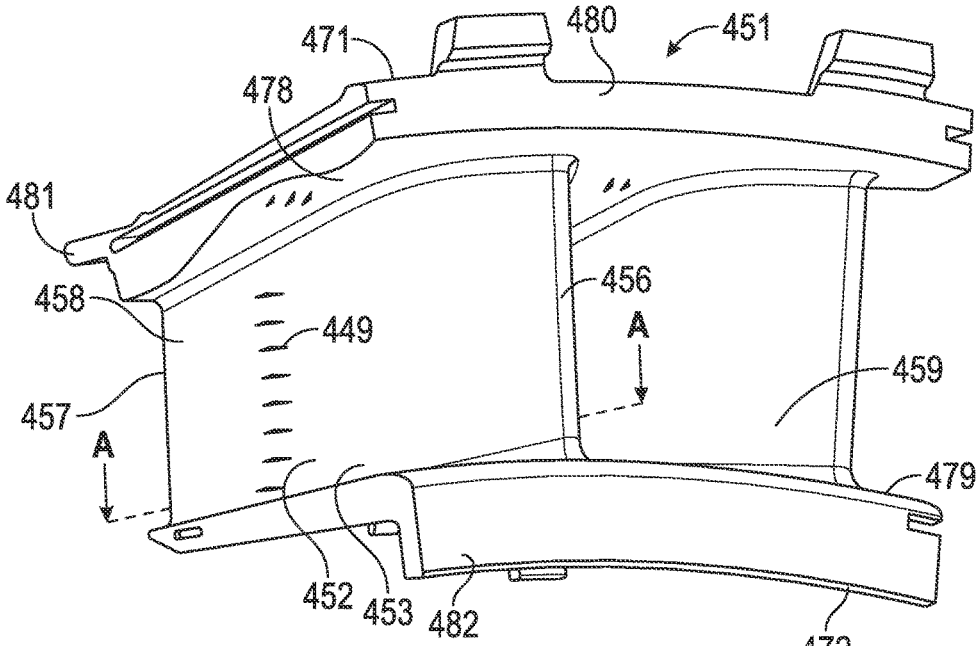
FIG. 2 is a perspective view of an embodiment of a turbine nozzle segment of the turbine depicted in FIG. 1.

FIG. 2 is a perspective view of an embodiment of a turbine nozzle segment 451 of the turbine 400 depicted in FIG. 1. In some embodiments, turbine nozzle segment 451 may include a plurality of turbine vanes. As depicted, turbine nozzle segment 451 may include a first turbine vane 452 and a second turbine vane 459. In other embodiments, turbine nozzle segment 451 may include one turbine vane 452. Turbine nozzle segment 451 may include an outer shrouding 471 and an inner shrouding 472. Outer shrouding 471 and inner shrouding 472 may each include a portion or a sector of an annular shape, such as a sector of a toroid or a sector of a hollow cylinder. The inner shrouding 472 may be located radially inward from the outer shrouding 471. Outer shrouding 471 may be located adjacent and radially inward from turbine housing 430 when turbine nozzle segment 451 is installed in gas turbine engine 100.

Outer shrouding 471 may include outer endwall 478. Outer endwall 478 may be a portion of an annular shape, such as a sector. For example, the sector may be a sector of a toroid (toroidal sector) or a sector of a hollow cylinder. The toroidal shape may be defined by a cross-section with an inner edge including a convex shape. Multiple outer endwalls 478 are arranged to form the annular shape, such as a toroid, and to define the radially outer surface of the flow path through a turbine nozzle 450. Outer endwall 478 may be coaxial to center axis 95 when installed in the gas turbine engine 100.

Outer shrouding 471 may also include outer forward rail 480 and outer aft rail 481. Outer forward rail 480 extends radially outward from outer endwall 478. As shown, outer forward rail 480 extends from outer endwall 478 at an axial end of outer endwall 478. In other embodiments, outer forward rail 480 may extend from outer endwall 478 near an axial end of outer endwall 478 and may be adjacent to the axial end of outer endwall 478. Outer forward rail 480 may include a lip, protrusion or other features that may be used to secure nozzle segment 451 to turbine housing 430.

Outer aft rail 481 may also extend radially outward from outer endwall 478. In the embodiment illustrated in FIG. 2, outer aft rail 481 is 'L' shaped, with a first portion extending radially outward from the axial end of outer endwall 478 opposite the location of outer forward rail 480, and a second portion extending in the direction opposite the location of outer forward rail 480 extending axially beyond outer endwall 478. In other embodiments, outer aft rail 481 includes other shapes and may be located near the axial end of outer endwall 478 opposite the location of outer forward rail 480 and may be adjacent to the axial end of outer endwall 478 opposite the location of outer forward rail 480. Outer aft rail 481 may also include other features that may be used to secure nozzle segment 451 to turbine housing 430.

Inner shrouding 472 is located radially inward from outer shrouding 471. Inner shrouding 472 may also be located adjacent and radially outward from turbine diaphragm 431 when nozzle segment 451 is installed in gas turbine engine 100. Inner shrouding 472 includes inner endwall 479. Inner endwall 479 is located radially inward from outer endwall 478. Inner endwall 479 may be a portion of an annular shape, such as a sector. For example, the sector may be a sector of a toroid (toroidal sector) or a sector of a hollow cylinder. The toroidal shape may be defined by a cross-section with an outer edge including a convex shape. Multiple inner endwalls 479 are arranged to form the annular shape, such as a toroid, and to define the radially inner surface of the flow path through a turbine nozzle 450. Inner endwall 479 may be coaxial to outer endwall 478 and center axis 95 when installed in the gas turbine engine 100.

Inner shrouding 472 may also include inner forward rail 482 and inner aft rail (not shown). Inner forward rail 482 extends radially inward from inner endwall 479. In the embodiment illustrated in FIG. 2, inner forward rail 482 extends from inner endwall 479 at an axial end of inner endwall 479. In other embodiments, inner forward rail 482 extends from inner endwall 479 near an axial end of inner endwall 479 and may be adjacent inner endwall 479 near the axial end of inner endwall 479. Inner forward rail 482 may include a lip, protrusion or other features that may be used to secure nozzle segment 451 to turbine diaphragm 431.

Inner aft rail may also extend radially inward from inner endwall 479. In some embodiments, inner aft rail may extend from inner endwall 479 near the axial end of inner endwall 479 opposite the location of inner forward rail 482 and may be adjacent the axial end of inner endwall 479 opposite the location of inner forward rail 482. Inner aft rail may also include a lip, protrusion or other features that may be used to secure nozzle segment 451 to turbine diaphragm 431.

Turbine vane 452 may include an airfoil 458 which extends radially between outer shrouding 471 and inner shrouding 472. Airfoil 458 may include a leading edge 456, a trailing edge 457, a pressure side wall 453, and a suction side wall 454 (see FIG. 5). Leading edge 456 may extend between outer shrouding 471 and inner shrouding 472 at the most upstream axial location where highest curvature is present. Trailing edge 457 may extend between outer shrouding 471 and inner shrouding 472 axially offset from and distal to leading edge 456. Trailing edge 457 may be located at the opposite end of airfoil 458 from leading edge 456.

When nozzle segment 451 is installed in gas turbine engine 100, leading edge 456 may be located axially forward and upstream of trailing edge 457. Leading edge 456 may be the point at the upstream end of airfoil 458 with the maximum curvature and trailing edge 457 may be the point at the downstream end of airfoil 458 with maximum curvature. In the embodiment illustrated in FIG. 1, nozzle segment 451 is part of the first stage turbine nozzle 450 adjacent combustion chamber 390. In other embodiments, nozzle segment 451 is located within a turbine nozzle 450 of another stage.

Pressure side wall 453 may span or extend from leading edge 456 to trailing edge 457. Pressure side wall 453 may include a concave shape. Suction side wall 454 may also span or extend from leading edge 456 to trailing edge 457. Suction side wall 454 may include a convex shape. Leading edge 456, trailing edge 457, pressure side wall 453 and suction side wall 454 may contain a cooling cavity there between.

Figure 5:
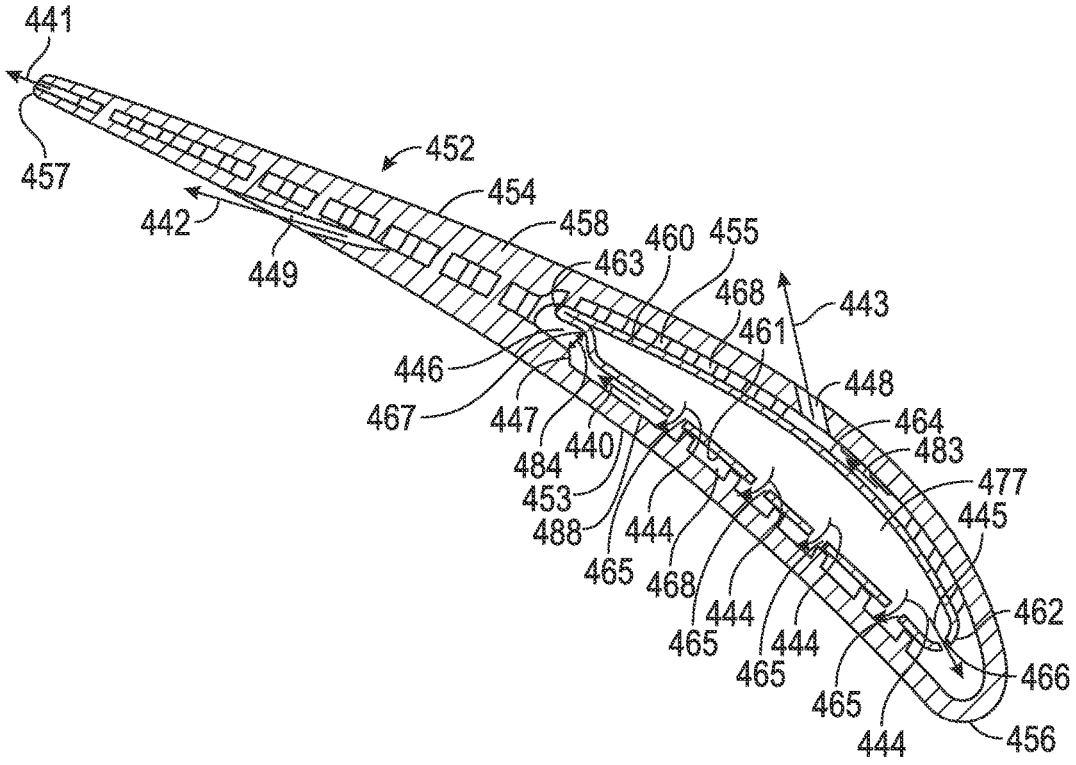
FIG. 5 is a top view of a cross section of the turbine vane of the turbine nozzle segment depicted in FIG. 2 taken along line A-A.

Airfoil 458 may include multiple cooling holes or apertures, such as pressure side film cooling apertures 449 and suction side film cooling apertures 448 (shown in FIG. 5). Each cooling aperture may be a channel extending through a wall of the airfoil 458. Pressure side film cooling apertures 449 may be configured to cool a portion of pressure side wall 453, and suction side cooling apertures 448 may be configured to cool a portion of suction side wall 454. Each set of cooling apertures may be grouped together in a pattern, such as in a row or in a column. In some instances, a row of cooling apertures, such as pressure side film cooling apertures 449, may be parallel to trailing edge 457. In some instances, airfoil 458 may include multiple rows of pressure side film cooling apertures 449. In particular instances, pressure side film cooling apertures 449 may be located or spaced about 5.08 mm (0.2 inch) to 304.8 mm (12 inch) from trailing edge 457. In some instances, pressure side film cooling apertures 449 may be located about 16 mm (0.63 inch) from trailing edge 457. In particular instances, pressure side film cooling apertures 449 may be spaced from trailing edge 457 about 10% to 70% of the total length from leading edge 456 to trailing edge 457.

In some embodiments, airfoil 458 may include a plurality of pressure side film cooling apertures 449. In some embodiments, airfoil 458 may include at least three pressure side film cooling apertures 449. In some embodiments, airfoil 458 may include eight pressure side film cooling apertures 449. In one embodiment, adjacent pressure side film cooling apertures 449 may be spaced apart from three to five pitch over diameter, the distance between the centers of adjacent apertures over the diameter of the apertures. In another embodiment, pressure side film cooling apertures 449 may be spaced apart by at least three pitch over diameter. In yet another embodiment, adjacent pressure side film cooling apertures 449 may be spaced apart up to five pitch over diameter. In other embodiments, adjacent pressure side film cooling apertures 449 may be spaced apart below three pitch over diameter and above five pitch over diameter. In certain instances, pressure side film cooling apertures 449 may have a diameter of 0.5 mm (0.02 inch) to 1 mm (0.04 inch). In certain instances, pressure side film cooling apertures 449 may have a diameter of about 0.64 mm (0.025 inch). In certain instances, suction side film cooling apertures 448 may have a diameter of 0.75 mm (0.03 inch) to 1.25 mm (0.05 inch). In certain instances, suction side film cooling apertures 448 may have a diameter of about 1.02 mm (0.04 inch).

In some embodiments, airfoil 458 may include a plurality of suction side film cooling apertures 448. In some embodiments, airfoil 458 may include at least three suction side film cooling apertures 448. In some embodiments, airfoil 458 may include eight suction side film cooling apertures 448. In one embodiment, adjacent suction side film cooling apertures 448 may be spaced apart from three to five pitch over diameter, the distance between the centers of adjacent apertures over the diameter of the apertures. In another embodiment, suction side film cooling apertures 448 may be spaced apart by at least three pitch over diameter. In yet another embodiment, adjacent suction side film cooling apertures 448 may be spaced apart up to five pitch over diameter. In other embodiments, adjacent suction side film cooling apertures 448 may be spaced apart below three pitch over diameter and above five pitch over diameter.

Second turbine vane 459 may include the same or similar features as first turbine vane 452.

Figure 3:
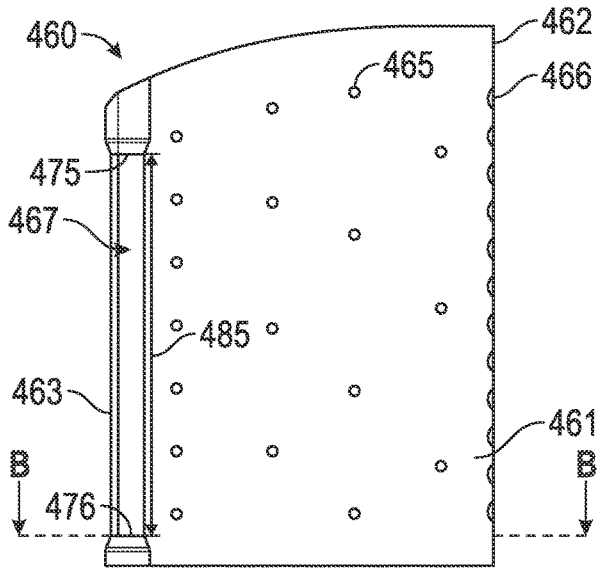
FIG. 3 is a front view of an embodiment of an insert tube.
Figure 4:
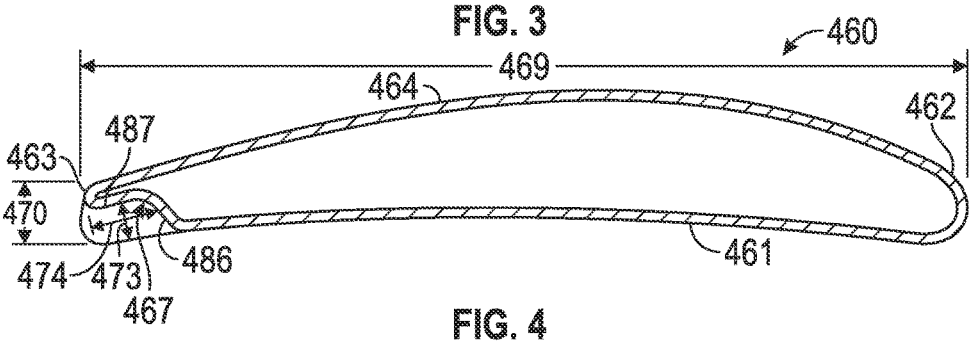
FIG. 4 is a top view of a cross section of the insert tube depicted in FIG. 3 taken along line B-B.

FIG. 3 and FIG. 4 depict a front view and top view, respectively of an embodiment of an insert tube 460. FIG. 4 is a top view of a cross section of the insert tube depicted in FIG. 3 taken along line B-B. Insert tube 460 may be a tubular, hollow structure featuring an airfoil cross section, similar to the cross section of a turbine vane, such as turbine vane 452. In some embodiments, insert tube 460 is a piece of sheet metal that is bent, brazed, and/or welded into a desired shape. In other embodiments, insert tube 460 may be casted or hydroformed. Insert tube 460 may be configured to be disposed within turbine vane 452. Insert tube 460 may include a pressure side wall 461 and a suction side wall 464, in which both walls may respectively correlate to the pressure side wall 453 and suction side wall 454 of turbine vane 452. Pressure side wall 461 and suction side wall 464 may be joined on one end by a leading edge 462, and joined on the opposite end by a trailing edge 463. Similarly, leading edge 462 and trailing edge 463 may respectively correlate to the leading edge 456 and trailing edge 457 of turbine vane 452. Insert tube 460 may have an overall length 469 measured from leading edge 462 to trailing edge 463. Trailing edge 463 may have a diameter 470 measured from one end of suction side wall 464 to one end of pressure side wall 461.

In some embodiments, pressure side wall 461, suction side wall 464, leading edge 462, and/or trailing edge 463 may include a plurality of cooling channels. In some instances, the cooling channels are impingement apertures or holes. For example, pressure side wall 461 may include a plurality of pressure side impingement apertures 465. Pressure side wall 461 may include a pattern of pressure side impingement apertures 465, in which each aperture is identical in shape and size. The pattern may aid in directing airflow over certain regions of insert tube 460 or turbine vane 452. In addition, leading edge 462 may include a plurality of leading edge impingement apertures 466. Leading edge impingement apertures 466 may propagate vertically along leading edge 462. Although not shown, additional impingement apertures in suction side wall 464 or trailing edge 463 may be formed. The combination of impingement apertures in each wall or edge of insert tube 460 may be designed to direct a cooling airflow path when insert tube 460 is disposed within turbine vane 452.

Insert tube 460 may also include an indented portion (sometimes referred to as a crimp) 467. Indented portion 467 may be located where trailing edge 463 transitions to the pressure side wall 461. In certain instances, indented portion 467 is formed by pressing a portion of pressure side wall 461 towards suction side wall 464. In some embodiments, indented portion 467 includes a curved wall 486 (sometimes referred to as first wall 487) and a flat wall 487 (sometimes referred to as second wall 487). Curved wall 486 may adjoin pressure side wall 461 and extend towards suction side wall 464. In some embodiments, curved wall 486 extends toward suction side wall 464 along a curved radius towards trailing edge 463. Curved wall 486 may adjoin flat wall 487. In some embodiments, flat wall 487 is approximately parallel to suction side wall 464. Furthermore, flat wall 487 may be adjacent to suction side wall 464. Flat wall 487 may adjoin trailing edge 463. In some instances, flat wall 487 is flat. In other instances, flat wall 487 is not completely flat.

In some instances, indented portion 467 has a depth 473. Depth 473 may be the distance between flat wall 487 and pressure side wall 461. In some embodiments, depth 473 is the length of the indentation after indented portion 467 is pressed towards pressure side wall 461. In some embodiments, depth 473 is 0.5 mm (0.02 inch) to 20.32 mm (0.8 inch). In some instances, depth 473 is about 1 mm (0.04 inch). In some instances, depth 473 is about 20% to 80% of the length of trailing edge diameter 470. In some instances, depth 473 is about 20% to 60% of the length of trailing edge diameter 470. In some instances, depth 473 is about 20% of the length of trailing edge diameter 470. In some instances, depth 473 is about 25% of the length of trailing edge diameter 470.

In some instances, indented portion 467 has a width 474. Width 474 may be the width of the indentation after indented portion 467 is pressed towards pressure side wall 461. Width 474 may be the distance between the center of curved wall 486 and trailing edge 463. In some embodiments, width 474 is 2.54 mm (0.1 inch) to 254 mm (10 inch). In some instances, width 474 is about 4 mm (0.16 inch). In some instances, width 474 is about 5% to 80% of length 469 of insert tube 460. In some instances, width 474 is about 5% to 10% of length 469 of insert tube 460. In some instances, width 474 is about 5% of length 469 of insert tube 460. In some instances, width 474 is about 7% of length 469 of insert tube 460.

Indented portion 467 may have a height 485. In some embodiments, indented portion 467 may extend between an upper mounting section 475 and a lower mounting section 476. Upper mounting section 475 may extend the top of insert tube 460 to a terminating end. Lower mounting section 476 may extend from the bottom of insert tube 460 to a terminating end. Height 485 may be the distance between the terminating ends of upper mounting section 475 and lower mounting section 476. In other embodiments, height 485 may extend from the top of insert tube 460 to the bottom of insert tube 460.

FIG. 5 is a top view of a cross section of the turbine vane 452 of the turbine nozzle segment 451 depicted in FIG. 2 taken along line A-A. As shown, airfoil 458 may include a cavity 477 extending radially from leading edge 456 a certain distance towards trailing edge 457. In some embodiments, cavity 477 may extend from leading edge 456 to approximate the center of airfoil 458. Furthermore, cavity 477 may extend in a perpendicular direction from pressure side wall 453 to suction side wall 454. Cavity 477 may be a hollow chamber configured to receive a high temperature resistant component, such as insert tube 460. As illustrated, insert tube 460 may be assembled into turbine vane 452. In particular, insert tube 460 may be assembled into cavity 477. The assembly of insert tube 460 into cavity 477 may form a channel between the outer wall of insert tube 460 and the inner wall 488 of airfoil 458. This channel may be referred to as cooling passage 468. In particular embodiments, cooling passage 468 may provide a vacuum to cool the region of airfoil 458 surrounding insert tube 460, as well as regions of airfoil 458 between insert tube 460 and trailing edge 457. In some embodiments, cooling passage 468 is a narrow channel having a width of 0.5 mm (0.02 inch) to 20.32 mm (0.8 inch). In some embodiments, cooling passage 468 has a width of about 0.89 mm (0.035 inch).

Cooling passage 468 may include a plurality of cavity pins 455. In certain instances, cavity pins 455 may aid in turbulating the airflow travelling through cavity 477, and thus provide additional cooling for airfoil 458. Cavity pins 455 may be cylindrical pins extending from an inner wall 488 of cavity 477 towards the outer wall of insert tube 460. Inner wall 488 may refer to any portion of the wall of cavity 477. In some embodiments, cavity pin 455 may fully extend between the inner wall 488 of cavity 477 and the outer wall of insert tube 460. In other embodiments, cavity pin 455 may extend from the inner wall 488 of cavity 477 to a certain location short of the outer wall of insert tube 460, leaving a narrow gap there between. Cavity pins 455 may propagate vertically and horizontally between the outer wall of insert tube 460 and the inner wall 488 of cavity 477. Furthermore, in some embodiments, cavity pins 455 may extend past cooling passage 468 towards trailing edge 457.

During operation of the gas turbine engine, gas may generally flow through airfoil 458 from leading edge 456 towards trailing edge 457. Such gas flow direction may be shown by arrow 440, arrow 441, and arrow 483. As mentioned above regarding FIG. 2, airfoil 458 may include multiple cooling apertures to aid in cooling certain regions of airfoil 458. Cooling apertures such as pressure side film cooling apertures 449 may aid in cooling pressure side wall 453, and suction side cooling apertures 448 may aid in cooling suction side wall 454. These apertures may be spaced apart in a row or column in their respective surfaces. Cooling air may travel through pressure side film cooling apertures 449 and suction side cooling apertures 448, as indicated by arrow 442 and arrow 443, respectively. Pressure side film cooling apertures 449 and suction side film cooling apertures 448 may provide a blanket of cooling air across pressure side wall 453 and suction side wall 454, respectively.

In particular embodiments, cooling air, such as compressed air 10 shown in FIG. 1, may be injected into cavity 477. Such cooling air may enter cavity 477 and escape out of insert tube 460 through at least one of the apertures located in the walls of insert tube 460. For instance, cooling air may escape through pressure side impingement apertures 465. Such cooling air may then travel through cooling passage 468 and outwards towards trailing edge 457. Insert tube 460 may also include at least one leading edge impingement aperture 466. Leading edge impingement aperture 466 may provide similar functions as pressure side impingement apertures 465. In addition, insert tube 460 may also include suction side impingement apertures (not shown).

In certain embodiments, a clearance 484 may be formed between indented portion 467 and the inner wall 488 of cavity 477. In particular, clearance 484 may be formed between an edge 447 of the inner wall 488 of cavity 477 and indented portion 467. Edge 447 may be an edge of an angled wall of inner wall 488 located near the center of airfoil 458, as depicted in the figure. In some embodiments, edge 447 may be an edge of inner wall 488 facing the curved wall 486 of indented portion 467. Clearance 484 may provide open space for cooling air to travel between insert tube 460 and airfoil 458. For instance, clearance 484 may form an open region 446. Open region 446 may increase airflow for cooling air and hot gas to travel through cooling passage 468 past indented portion 467 towards trailing edge 457. In particular instances, clearance 484 may be 0.5 mm (0.02 inch) to 20.32 mm (0.8 inch). In particular instances, clearance 484 may be about 1 mm (0.04 inch).

One or more of the above components (or their subcomponents) may be made from a base material that is stainless steel and/or durable, high temperature materials known as "superalloys". The base material may also be a type of ceramic. A superalloy, or high-performance alloy, is an alloy that exhibits excellent mechanical strength and creep resistance at high temperatures, good surface stability, and corrosion and oxidation resistance.

Superalloys may include materials such as alloy x, WASPALOY, RENE alloys, alloy 188, alloy 230, alloy 17-4PH, INCOLOY, INCONEL, MP98T, TMS alloys, and CMSX single crystal alloys.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with the 4th compressor disk assembly 220 in the downstream or "aft" direction, going from the inlet 110 towards the exhaust 500). Likewise, each turbine disk assembly 420 may be associated with a numbered stage.

Once compressed air 10 leaves the compressor 200, it enters the combustor 300, where it is diffused and fuel is added. Air 10 and fuel are injected into the combustion chamber 390 via fuel injector 310 and combusted. Energy is extracted from the combustion reaction via the turbine 400 by each stage of the series of turbine disk assemblies 420. Exhaust gas 90 may then be diffused in exhaust diffuser 510, collected and redirected. Exhaust gas 90 exits the system via an exhaust collector 520 and may be further processed (e.g., to reduce harmful emissions, and/or to recover heat from the exhaust gas 90).

Operating efficiency of a gas turbine engine generally increases with a higher combustion temperature. Thus, there is a trend in gas turbine engines to increase the combustion temperatures. Gas reaching forward stages of a turbine from a combustion chamber 390 may be 1000 degrees Fahrenheit or more. To operate at such high temperatures a portion of the compressed air 10 from the compressor 200, cooling air, may be diverted through internal passages or chambers to cool various components of a turbine including nozzle segments such as nozzle segment 451. A pressure differential may form in the turbine nozzle due to the external pressure caused by the combusted fuel travelling past the turbine nozzle and the internal pressure from the compressed air diverted into the turbine nozzle.

Referring to FIG. 1 and FIG. 5, cooling air, such as compressed air 10, may be diverted through turbine housing 430, turbine diaphragm 431, and into cavity 477. The cooling air may be diverted through impingement apertures located in the walls of insert tube 460, such as pressure side impingement apertures 465 and leading edge impingement apertures 466. Such impingement apertures may allow cooling air to escape from within cavity 477 out into cooling passage 468. The cooling air flowing through cooling passage 468 may aid in cooling the surrounding airfoil 458. In addition, the cooling air may travel towards trailing edge 457 and thus aiding in cooling that portion of airfoil 458.

In some instances, cooling air may be choked off in certain regions of cooling passage 468. In such instances, the cooling air may not be able to reach regions downstream of the choked off regions. For example, open region 446 may be provided to allow for proper air flow of the cooling air from cooling passage 468 towards trailing edge 457. In particular, open region 446 may aid in providing proper cooling air flow along pressure side wall 453. A clearance 484 may be formed between edge 447 and a portion of insert tube 460, such as indented portion 467, to provide sufficient clearance between insert tube 460 and airfoil 458. In some embodiments, indented portion 467 is formed by crimping a portion of insert tube 460 between trailing edge 463 and pressure side wall 461. In some embodiments, the clearance may lower the surface temperature of certain portions of the airfoil, particularly portions of pressure side wall 453, by 200 to 300 degrees Fahrenheit.

The preceding detailed description is merely exemplary in nature and is not intended to limit the invention or the application and uses of the invention. The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. An insert tube of a turbine vane, the insert tube comprising:

a pressure side wall;

a suction side wall opposite and spaced apart from the pressure side wall;

a leading edge formed between the pressure side wall and the suction side wall at a first end of the insert tube;

a trailing edge formed between the pressure side wall and the suction side wall at a second end of the insert tube, the second end of the insert tube being located opposite the first end of the insert tube, the pressure side wall, the suction side wall, the leading edge, and the trailing edge at least partly defining an internal volume of the insert tube;

and an indented portion extending between the trailing edge and the pressure side wall, the indented portion including a curved wall adjoining the pressure side wall and extending towards the suction side wall, and a flat wall adjoining the curved wall and the trailing edge, the pressure side wall defining a plurality of pressure side impingement apertures spaced along and extending through the pressure side wall, the leading edge defining a plurality of leading edge impingement apertures spaced along and extending through the leading edge, wherein the indented portion has an overall height that extends along the trailing edge, and that is defined entirely between an upper mounting section and a lower mounting section of the insert tube the insert tube has an overall height that extends along the trailing edge.

2. The insert tube of claim 1, wherein the curved wall extends towards the trailing edge along a radius.

3. The insert tube of claim 1, wherein the insert tube includes an overall length, and the indented portion includes a width about 5 to 80 percent of the overall length of the insert tube.

4. The insert tube of claim 3, wherein the trailing edge includes a diameter measured from one end of suction side wall to one end of pressure side wall, and the indented portion includes a depth that is about 20 to 80 percent of the trailing edge diameter.

5. The insert tube of claim 4, wherein the width of the indented portion is about 4 mm, and the depth of the indented portion is about 1 mm.

6. The insert tube of claim 1, wherein the plurality of pressure side impingement apertures propagate in a row parallel to the trailing edge.

7. The insert tube of claim 6, wherein the plurality of pressure side impingement apertures are spaced about 4 mm from the trailing edge.

8. The insert tube of claim 1, wherein the plurality of leading edge impingement apertures propagate in a row along the leading edge.

9. A nozzle segment for a nozzle ring of a gas turbine engine, the nozzle segment comprising:

an outer endwall;

an inner endwall;

an airfoil extending between the outer endwall and the inner endwall, the airfoil including a leading edge extending from the outer endwall to the inner endwall, a trailing edge extending from the outer endwall to the inner endwall distal to the leading edge, a pressure side wall extending from the leading edge to the trailing edge, a suction side wall extending from the leading edge to the trailing edge, a plurality of pressure side film cooling apertures spaced along the pressure side wall, a plurality of suction side film cooling apertures spaced along the suction side wall, and a cavity extending from the leading edge a certain distance towards the trailing edge in one direction, and extending from the pressure side wall to the suction side wall in a perpendicular direction, the cavity including an inner wall;

an insert tube disposed within the cavity of the airfoil, the insert tube including a pressure side wall, a suction side wall opposite and spaced apart from the pressure side wall, a leading edge formed between the pressure side wall and the suction side wall at a first end of the insert tube, and a trailing edge formed between the pressure side wall and the suction side wall at a second end of the insert tube , the second end of the insert tube being located opposite the first end of the insert tube, the pressure side wall, the suction side wall, the leading edge, and the trailing edge at least partly defining an internal volume of the insert tube; and an indented portion located between the trailing edge and the pressure side wall, the indented portion including a curved wall adjoining the pressure side wall and extending towards the suction side wall, and a flat wall adjoining the curved wall and the trailing edge, the pressure side wall defining a plurality of pressure side impingement apertures spaced along and extending through the pressure side wall, the leading edge defining a plurality of leading edge impingement apertures spaced along and extending through the leading edge, the inner wall of the cavity and indented portion having a clearance there between, wherein the indented portion has an overall height that extends along the trailing edge, and that is defined entirely between an upper mounting section and a lower mounting section of the insert tube the insert tube has an overall height that extends along the trailing edge.

10. The nozzle segment of claim 9, wherein the clearance is formed between the indented portion and an edge of the inner wall located near the center of the airfoil.

11. The nozzle segment of claim 9, wherein the clearance provides an open region between the indented portion and the inner wall of the cavity.

12. The nozzle segment of claim 9, wherein the plurality of pressure side film cooling apertures propagate in a row parallel to the trailing edge.

13. The nozzle segment of claim 12, wherein the plurality of pressure side film cooling apertures are spaced from trailing edge about 10% to 70% of a total length from the leading edge to the trailing edge.

14. The nozzle segment of claim 9, wherein the plurality of suction side film cooling apertures propagate in a row parallel to the leading edge.

15. A insert tube for assembly in a cavity of a turbine vane, the insert tube comprising:

a pressure side wall;

a suction side wall opposite and spaced apart from the pressure side wall;

a leading edge formed between the pressure side wall and the suction side wall at a first end of the insert tube;

a trailing edge formed between the pressure side wall and the suction side wall at a second end of the insert tube, the second end of the insert tube being located opposite the first end of the insert tube, the pressure side wall, the suction side wall, the leading edge, and the trailing edge at least partly defining an internal volume of the insert tube; and an indented portion located between the trailing edge and the pressure side wall, the indented portion including a first wall adjoining the pressure side wall and extending towards the suction side wall, and a second wall adjoining the first wall and the trailing edge, the pressure side wall defining a plurality of pressure side impingement apertures spaced along and extending through the pressure side wall, the leading edge defining a plurality of leading edge impingement apertures spaced along and extending through the leading edge, the indented portion being configured to be spaced apart from a wall of the cavity, wherein the indented portion has an overall height that extends along the trailing edge, and that is defined entirely between an upper mounting section and a lower mounting section of the insert tube the insert tube has an overall height that extends along the trailing edge.

16. The insert tube of claim 15, wherein the indented portion is formed by crimping.

17. The insert tube of claim 15, wherein the wall of the cavity includes an edge, the first wall of the indented portion being configured to define a clearance between the edge and the first wall of the indented portion.

18. The insert tube of claim 17, wherein the clearance forms an open region in the cavity, the open region being configured to provide air flow through the cavity.

19. The insert tube of claim 15, wherein the plurality of pressure side impingement apertures propagate in a row parallel to the trailing edge.

20. The insert tube of claim 1, wherein the plurality of pressure side impingement apertures are in direct fluid communication with the plurality of leading edge impingement apertures via the internal volume of the insert tube.

* * * * *